US007022053B2

(12) United States Patent
Whetstone

(10) Patent No.: US 7,022,053 B2
(45) Date of Patent: Apr. 4, 2006

(54) BARBELL/DUMBBELL TRAINING SUPPORT DEVICE

(76) Inventor: Donnie R. Whetstone, 313 E. 5 th Ave., Olympia, WA (US) 98501

( * ) Notice: Subject to any disclaimer, the term of this patent is extended or adjusted under 35 U.S.C. 154(b) by 96 days.

(21) Appl. No.: 10/820,045

(22) Filed: Apr. 8, 2004

(65) Prior Publication Data

US 2004/0259697 A1 Dec. 23, 2004

Related U.S. Application Data

(60) Provisional application No. 60/479,414, filed on Jun. 18, 2003.

(51) Int. Cl.
*A63B 21/078* (2006.01)

(52) U.S. Cl. ..... 482/104; 482/92; 211/126.1; 248/127

(58) Field of Classification Search ..... 482/104, 482/106, 108; D21/686; 108/16, 55.3, 57, 108/29, 30
See application file for complete search history.

(56) References Cited

U.S. PATENT DOCUMENTS

| | | | | |
|---|---|---|---|---|
| 1,748,656 A * | 2/1930 | Saemisch | 108/187 |
| 3,118,668 A | 1/1964 | Callahan | 482/104 |
| 3,132,609 A * | 5/1964 | Chesley | 108/106 |
| 3,268,224 A | 8/1966 | Freshour | 482/104 |
| 4,262,901 A | 4/1981 | Faust | 482/104 |
| 4,368,884 A | 1/1983 | Colvin | 482/104 |
| 4,579,233 A * | 4/1986 | Hepp | 211/126.12 |
| 4,635,930 A | 1/1987 | Courmier | 482/104 |
| 4,666,150 A | 5/1987 | Segrist et al. | 482/104 |
| 4,773,642 A | 9/1988 | Cruz | 482/104 |
| 4,934,693 A | 6/1990 | Santoro | 482/98 |
| 5,616,108 A | 4/1997 | Hayden | 482/104 |
| 5,630,776 A | 5/1997 | Yang | 482/104 |
| 5,637,059 A * | 6/1997 | Dalebout | 482/52 |
| 5,954,619 A | 9/1999 | Petrone | 482/104 |
| 5,971,898 A | 10/1999 | Schoolfield | 482/104 |
| D425,152 S | 5/2000 | Ceppo | D21/686 |
| D425,950 S | 5/2000 | Ceppo | D21/686 |
| D429,295 S | 8/2000 | Ceppo | D21/686 |
| 6,123,651 A | 9/2000 | Ellenburg | 482/104 |
| 6,149,556 A | 11/2000 | Jordan | 482/104 |
| D441,813 S | 5/2001 | Ceppo | D21/686 |
| D443,660 S | 6/2001 | Ceppo | D21/686 |
| D446,560 S | 8/2001 | Ceppo | D21/686 |
| D453,542 S | 2/2002 | Louiso | D21/694 |
| 6,406,409 B1 | 6/2002 | Silver | 482/104 |

FOREIGN PATENT DOCUMENTS

| | | |
|---|---|---|
| DE | 3546203 A1 | 7/1987 |
| DE | 3744449 A1 | 7/1989 |

* cited by examiner

*Primary Examiner*—Stephen R. Crow
*Assistant Examiner*—Allana Lewin
(74) *Attorney, Agent, or Firm*—Richard C. Litman

(57) ABSTRACT

A barbell/dumbbell training support device includes a base with distal ends, a cross support laterally extending equidistantly from each distal end of the base for a predetermined distance, the cross supports being configured to prevent tipping of the support device, an elongated tray configured to support barbells and dumbbells, and connection elements configured to interconnect the base with the elongated tray. Ends of each cross support may have attached thereto pads, covers, or elevated attachments made from flexible and resilient material. The elongated tray is a generally elongated rectangle having a surface and lengthwise sides with ends and widthwise sides with ends. Raised edges extend from each of the corresponding lengthwise and widthwise sides of the tray.

14 Claims, 8 Drawing Sheets

BARBELL/DUMBBELL TRAINING SUPPORT DEVICE

CROSS REFERENCE TO RELATED APPLICATIONS

This application claims priority to provisional application Ser. No. 60/479,414, filed Jun. 18, 2003, which is incorporated herein by reference.

BACKGROUND OF THE INVENTION

1. Field of the Invention

The present invention generally relates to support systems for barbells and dumbbells and, more particularly, to a barbell/dumbbell training support device that is durable, light weight, space friendly, versatile, and that enhances training performance, promotes safe training environment, and protects other equipment from unauthorized use.

2. Description of the Related Art

In commercial gyms, fitness centers, and home gyms, lifters of all training levels commonly are left with three options of training support during their workouts. These options are storage racks, the floor, and body support flat benches. Over the years these options have presented a number of problems. Storage racks offer an excellent means of long term storage support for barbells and dumbbells. However, lifters object because the equipment is often cumbersome to use for training support. Training support is defined as having to retrieve and recover barbells or dumbbells repeatedly, as in multiple sets of an exercise. Barbell storage rack designs often render shorter lifters unable too retrieve desired barbells. Dumbbell storage rack designs often put lifters in awkward positions to retrieve dumbbells as heavy as 140 pounds each, thereby putting excess pressure on the lower back. Furthermore, lifters are susceptible to injuries such as smashed fingers when using long term storage racks for barbell training support.

The floor is a common means of training support but is the least desired for obvious reasons. Lifters object since using the floor for training support requires a lot of energy, especially with heavy loads, and therefore affects training performance. Lifters are often subject to low back injuries. Floors are subject to accelerated wear and tear even with protected padding. Furthermore, train wearied lifters often leave barbells and dumbbells on the floor when finished in which other lifters can trip and fall creating a hazardous training environment.

The body support flat bench is the most common and most desired means of barbell and dumbbell training support. Lifters object because the use of a body support bench for barbell and dumbbell training support denies them of the equipment's designed purpose. Upholstery on body support flat benches is subject to accelerated wear and tear when used for barbell and dumbbell training support. Furthermore, many barbells and dumbbells can easily roll off body support benches and break a toe or foot, thereby creating a hazardous training environment. The inventor is unaware of any single training support device that accommodates both standard barbells as well as dumbbell training support. Therefore, a need exists for a heavy duty barbell/dumbbell training support device that is durable, light weight, space friendly, versatile, and that enhances training performance, promotes safe training environment, and protects other equipment from unauthorized use, and that accommodates both standard barbells as well as dumbbell training support.

The related art is represented by the following references of interest.

U.S. Design Pat. Nos. 425,152, 425,950, 425,295, 441,813 S, 443,660 S, and 446,560 S, issued on May 16, 2000, May 30, 2000, Aug. 8, 2000, May 8, 2001, Jun. 12, 2001, and Aug. 14, 2001 to Louis Ceppo, show ornamental designs for dumbbell holder stands, a dumbbell holder stands support, and a safety spotter box for barbells. The Ceppo patents do not suggest a barbell/dumbbell training support device according to claimed invention.

U.S. Design Pat. No. 453,542 S, issued on Feb. 12, 2002 to David T. Louiso, shows an ornamental design for a dumbbell rest. The Louiso patent does not suggest a barbell/dumbbell training support device according to claimed invention.

U.S. Pat. No. 3,118,668, issued on Jan. 21, 1964 to George Callahan, describes a barbell exercising device that allows barbell push-ups to be performed with safety. The Callahan patent does not suggest a barbell/dumbbell training support device according to claimed invention.

U.S. Pat. No. 3,268,224, issued on Aug. 23, 1966 to George W. Freshour, describes a supporting frame for bar bells and hand operated exercising devices. The Freshour patent does not suggest a barbell/dumbbell training support device according to claimed invention.

U.S. Pat. No. 4,262,901, issued on Apr. 21, 1981 to Reginald O. Faust, describes a frame including vertically adjustable main support arms for receiving a bar bell prior to exercising. The Faust patent does not suggest a barbell/dumbbell training support device according to claimed invention.

U.S. Pat. No. 4,368,884, issued on Jan. 18, 1983 to Randy G. Colvin, describes a safety bench press apparatus which prevents injury from the droppage of barbells. The Colvin patent does not suggest a barbell/dumbbell training support device according to claimed invention.

U.S. Pat. No. 4,635,930, issued on Jan. 13, 1987 to Gary Cormier, describes a safety bench press apparatus which prevents injuries as a consequence of a dropping or otherwise uncontrolled impact of the barbell upon a weight lifter. The Cormier patent does not suggest a barbell/dumbbell training support device according to claimed invention.

U.S. Pat. No. 4,666,150, issued on May 19, 1987 to Joseph S. Segrist et al., describes a saddle mountable on telescoping members or permanent members that will support a complete tubular cooperating with an open area centrally located throughout the dumbbell receiving area saddle to allow a hand to pass through on the return of the dumbbell to the saddle. The Segrist et al. device lacks stability and can easily be knocked over during intense training. The Segrist et al. patent does not suggest a barbell/dumbbell training support device according to claimed invention.

U.S. Pat. No. 4,773,642, issued on Sep. 27, 1988 to Raynaldo T. Cruz, describes an exercise weight supporting device to accommodate both dumbbells and barbells. The Cruz patent does not suggest a barbell/dumbbell training support device according to claimed invention.

U.S. Pat. No. 4,934,693, issued on Jan. 19, 1990 to John G. Santoro, describes a multi-free exercise free weight exercise apparatus for preventing injury to a weight lifter from a weight bearing bar and weights thereon in the event the weight lifter is unable to complete another repetition of the exercise due to any circumstance. The Santoro patent does not suggest a barbell/dumbbell training support device according to claimed invention.

U.S. Pat. No. 5,616,108, issued on Apr. 1, 1997 to Richard C. Hayden, describes a dumbbell support attachment for holding a dumbbell from a barbell cross bar so that the dumbbell can be used with a typical weight lifting bench. The Hayden device limits lifters to exercises that can be used with a crossbar for dumbbell support. The Hayden patent does not suggest a barbell/dumbbell training support device according to claimed invention.

U.S. Pat. No. 5,630,776, issued on May 20, 1997 to Lien-Chuan Yang, describes a folding dumbbell rest which includes a handle attached to a V-shaped plate. The Yang patent does not suggest a barbell/dumbbell training support device according to claimed invention.

U.S. Pat. No. 5,954,619, issued on Sep. 21, 1999 to Charles M. Petrone, describes an apparatus for use in the storing of a dumbbell in position for presentation to a user at a desired height of the dumbbell for commencement of an exercise routine. The Petrone patent does not suggest a barbell/dumbbell training support device according to claimed invention.

U.S. Pat. No. 5,971,898, issued on Oct. 26, 1999 to Darrell Schoolfield, describes a sliding weight rack for removably holding free weights provided on a weight lifting bench. The Schoolfield patent does not suggest a barbell/dumbbell training support device according to claimed invention.

U.S. Pat. No. 6,123,651, issued on Sep. 26, 2000 to Howard S. Ellenburg, describes a barbell holder and methods for its use. The Ellenburg patent does not suggest a barbell/dumbbell training support device according to claimed invention.

U.S. Pat. No. 6,149,556, issued on Nov. 21, 2000 to Duke M. Jordan, describes a multi-level dumbbell support apparatus having a single frame structure into which two adjustable dumbbell supports are integrated. The Jordan device takes up a great deal of space and would not be suitable for many home gyms. The Jordan patent does not suggest a barbell/dumbbell training support device according to claimed invention.

U.S. Pat. No. 6,406,409 B1, issued on Jun. 18, 2002 to Michael I. Silver, describes a combination of a set of free weight plates of at least two different sizes and a rack thereof. The Silver patent does not suggest a barbell/dumbbell training support device according to claimed invention.

German Patent Application Publication No. De 3546203 A1, published on Jul. 2, 1987, describes a storage space for long dumbbell rods with weights. The German '203 application does not suggest a barbell/dumbbell training support device according to claimed invention.

German Patent Application Publication No. DE 3744449 A1, published on Jul. 13, 1989, describes a storage for dumbbells with long bars. The German '449 application does not suggest a barbell/dumbbell training support device according to claimed invention.

None of the above inventions and patents, taken either singly or in combination, is seen to describe the instant invention as claimed. Thus a barbell/dumbbell training support device solving the aforementioned problems is desired.

SUMMARY OF THE INVENTION

The present invention is a barbell/dumbbell training support. The barbell/dumbbell training support device includes a base with distal ends, a cross support laterally extending equidistantly from each distal end of the base for a predetermined distance, the cross supports being configured to prevent tipping of the support device, an elongated tray configured to support barbells and dumbbells, and connection elements configured to interconnect the base with the elongated tray. Ends of each cross support may have attached thereto pads, covers, or elevated attachments made from flexible and resilient material.

The elongated tray is a generally elongated rectangle having a surface and lengthwise sides with ends and widthwise sides with ends. Raised edges extend from each of the corresponding lengthwise and widthwise sides of the tray. Flat barbell support surfaces having edges extend along the ends and on tops of at least one of the raised edges along the lengthwise sides of the tray. Angled elements extend away from the edges of the flat barbell support surfaces and above the raised edges of the lengthwise sides and toward a center of the tray. Flat barbell support surfaces having edges may extend along the center and on tops of at least one of the raised edges along the widthwise sides of the tray. Longitudinally extending angled portions extend from the ends of the widthwise raised edges. The elongated tray may include a protective coating similar to protective lining used on truck beds.

Accordingly, it is a principal aspect of the invention to provide a barbell/dumbbell training support device including a base with distal ends, a cross support laterally extending equidistantly from each distal end of the base for a predetermined distance, the cross supports being configured to prevent tipping of the support device, an elongated tray configured to support barbells and dumbbells, and connection elements configured to interconnect the base with the elongated tray. Ends of each cross support may have attached thereto pads, covers, or elevated attachments made from flexible and resilient material.

It is another aspect of the invention to provide a barbell/dumbbell training support method that provides a base with distal ends, provides a cross support laterally extending equidistantly from each distal end of the base for a predetermined distance, the cross supports being configured to prevent tipping of the support device, provides an elongated tray configured to support barbells and dumbbells; and interconnects the base with the elongated tray.

It is an aspect of the invention to provide improved elements and arrangements thereof in a barbell/dumbbell training support device for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
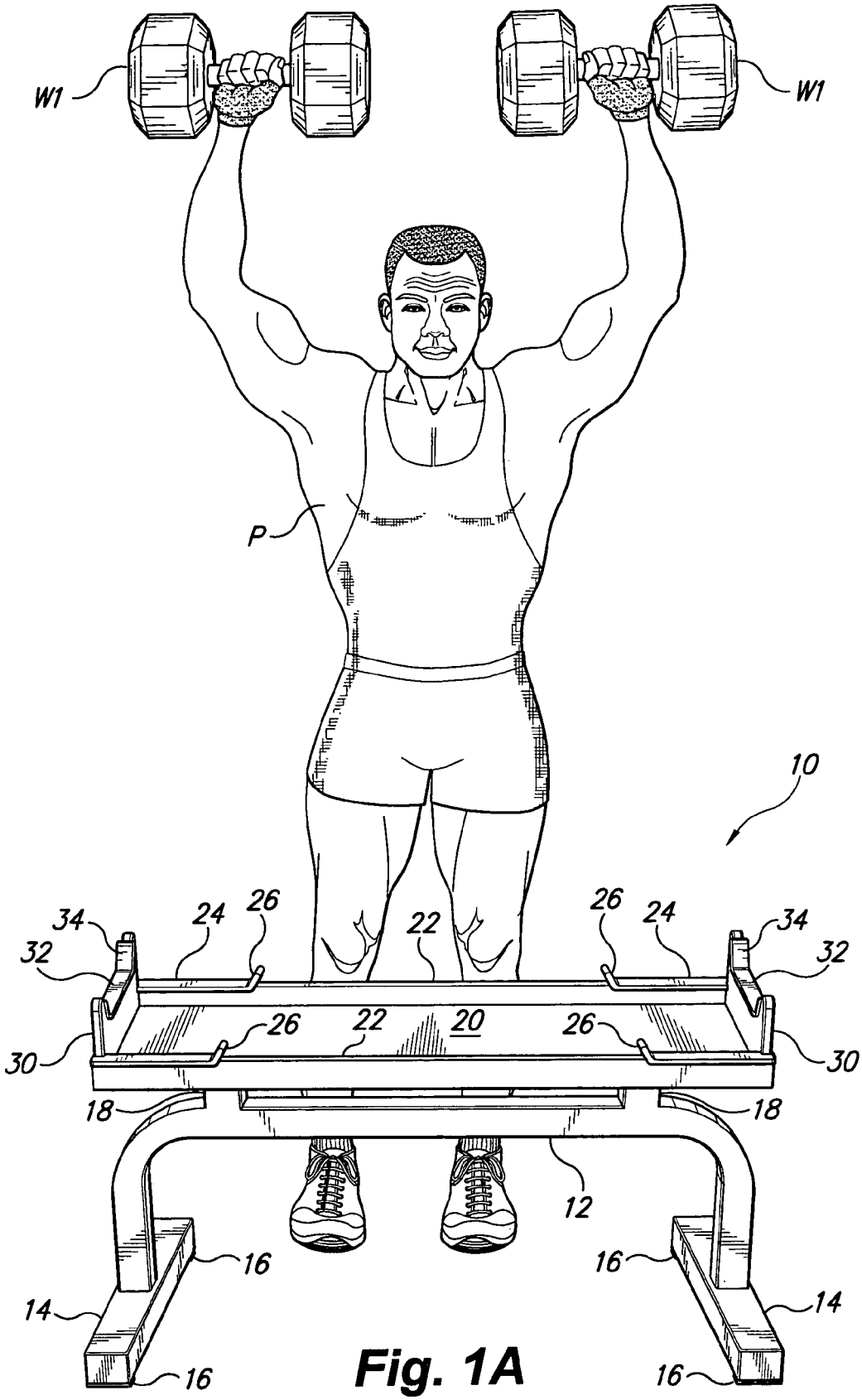
FIG. 1A is an environmental, perspective view of a barbell/dumbbell training support device being used by an individual with dumbbells positioned off of the support device according to the present invention.

The present invention is a barbell/dumbbell training support device. The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

Figure 1B:
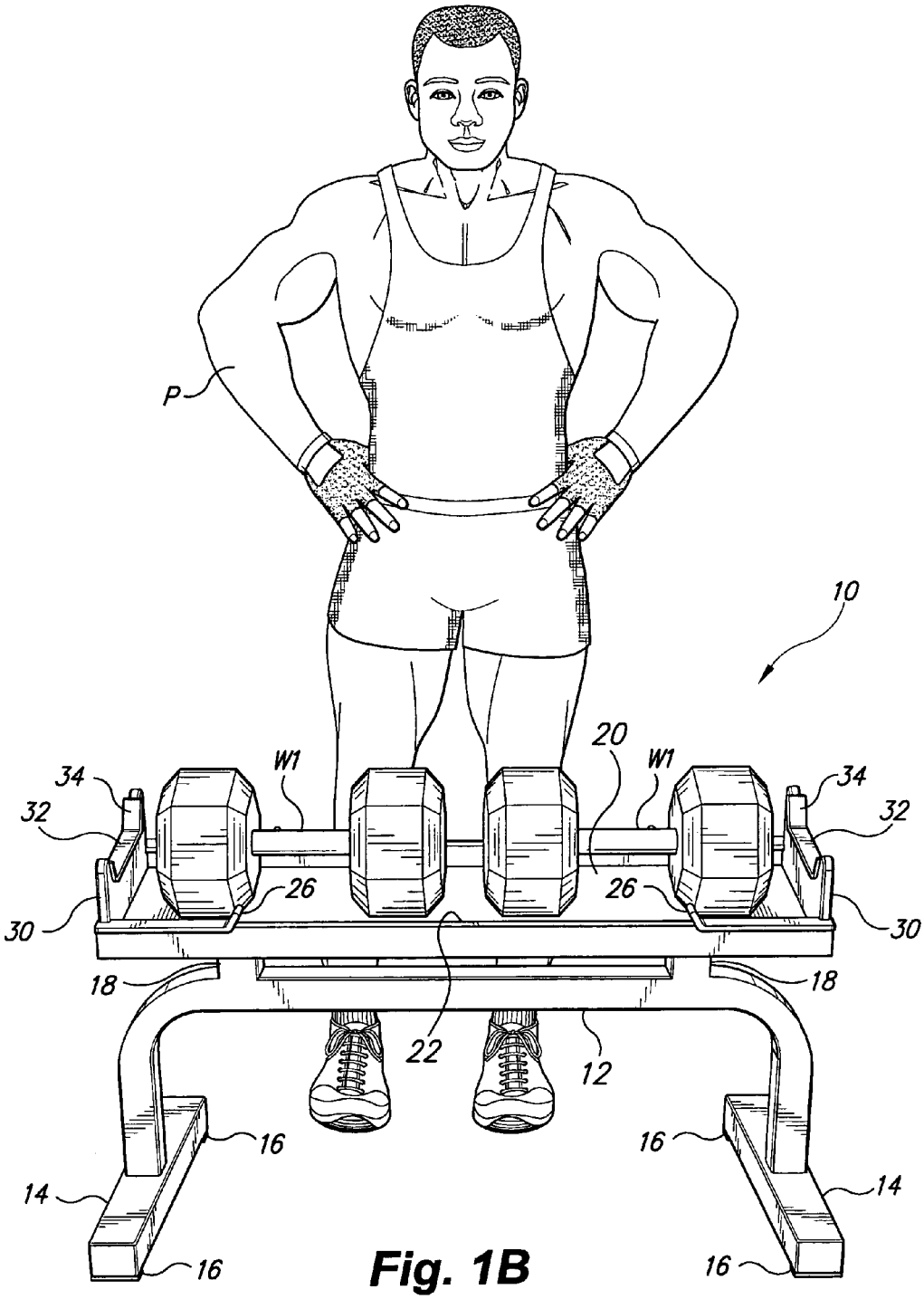
FIG. 1B is an environmental, perspective view of a barbell/dumbbell training support device being used by an individual with dumbbells positioned on the support device according to the present invention.
Figure 2:
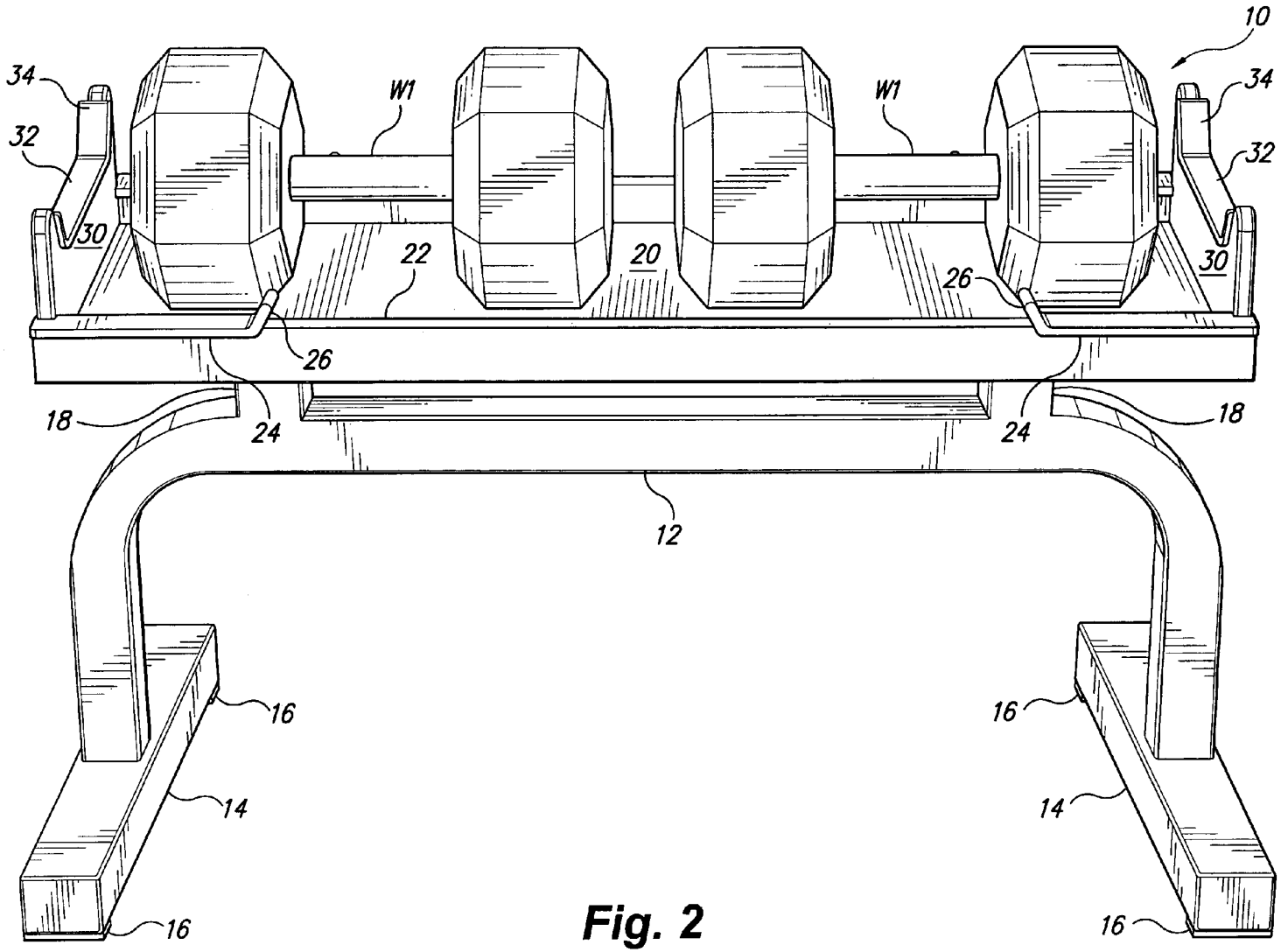
FIG. 2 is a front perspective view of a barbell/dumbbell training support device with a pair of dumbbells positioned on the support device according to the present invention.
Figure 3:
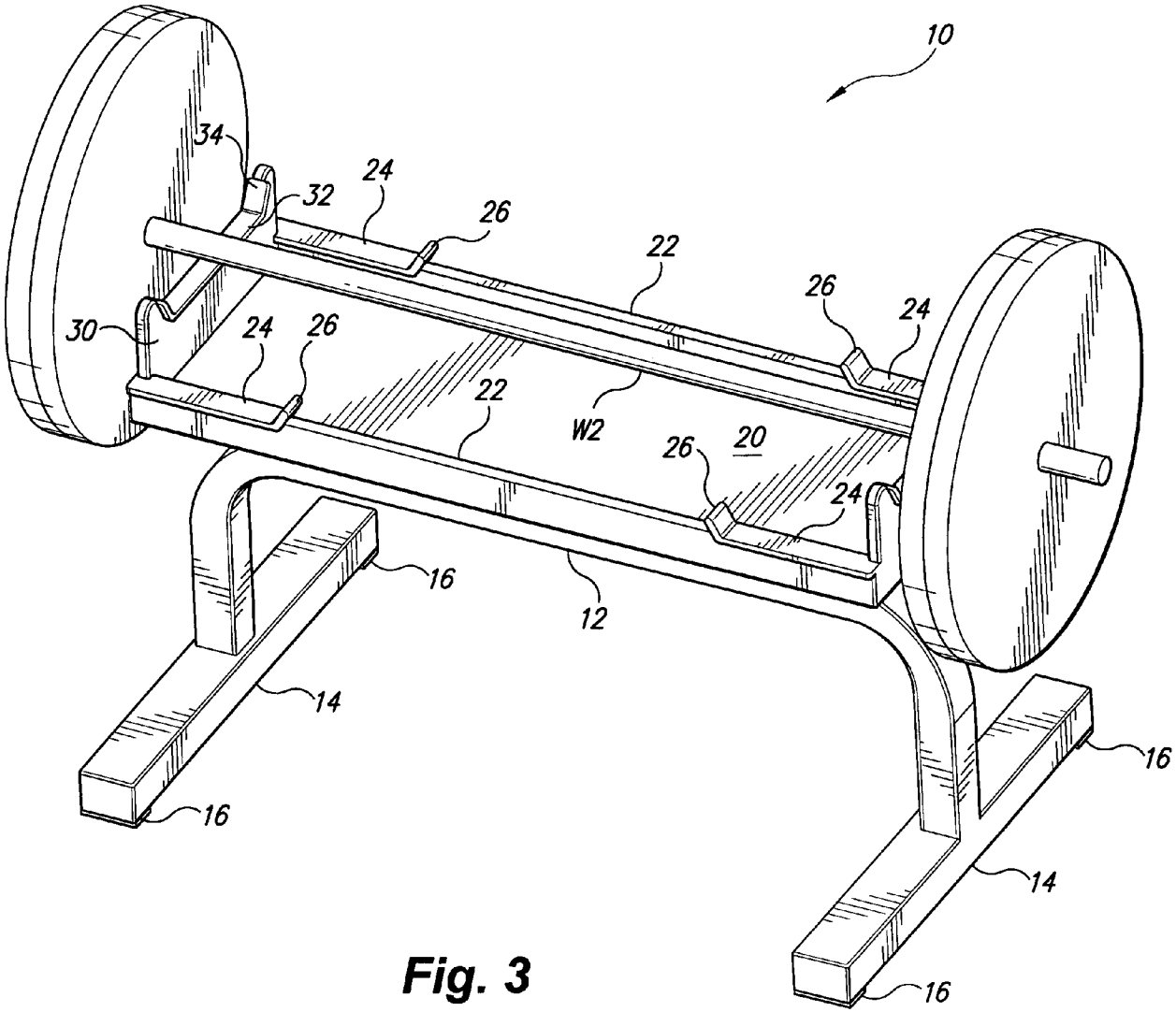
FIG. 3 is a front perspective view of a barbell/dumbbell training support device with one type of barbell positioned lengthwise on the support device according to the present invention.
Figure 4:
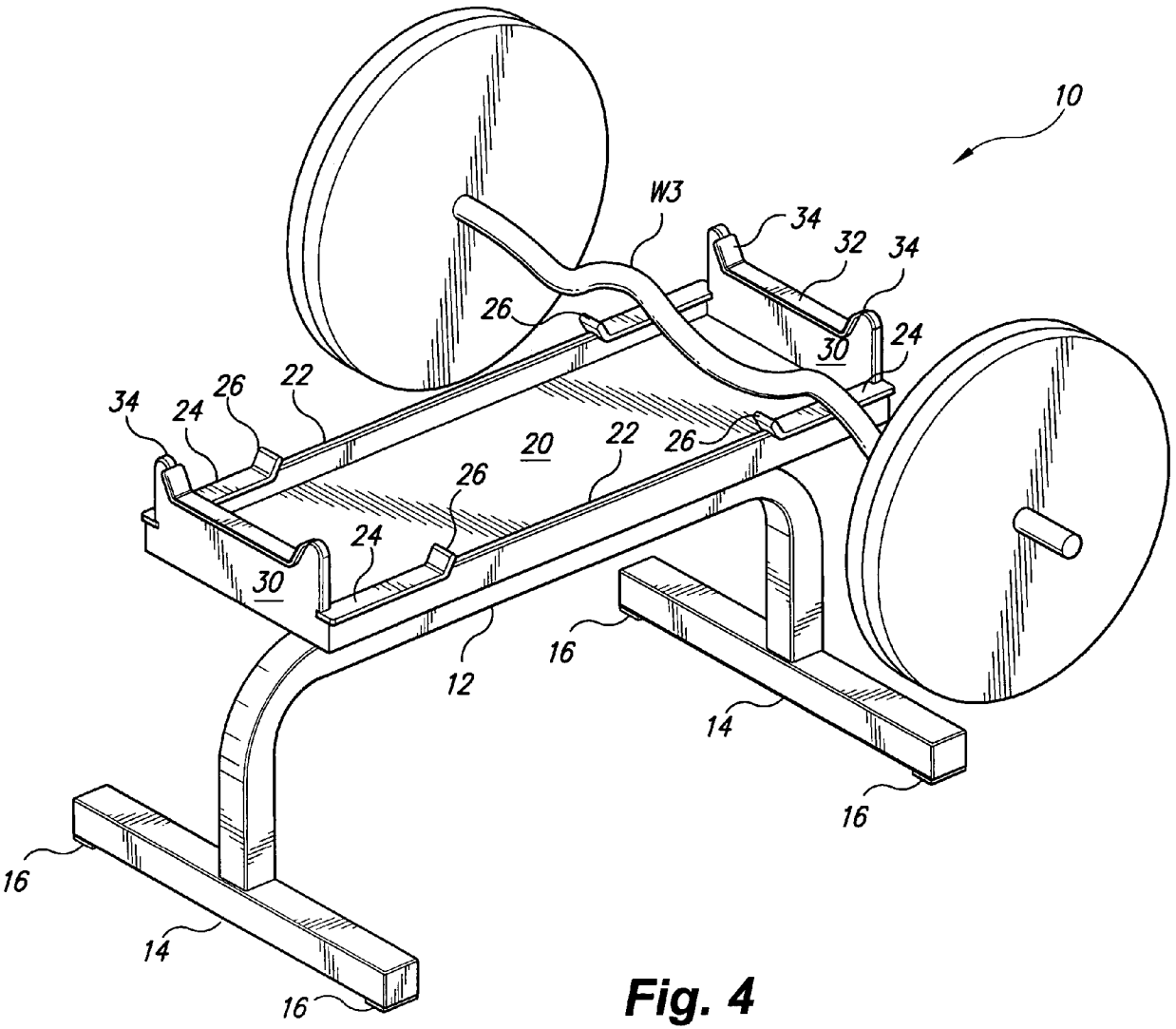
FIG. 4 is a front perspective view of a barbell/dumbbell training support device with one type of barbell positioned crosswise on the support device according to the present invention.
Figure 5:
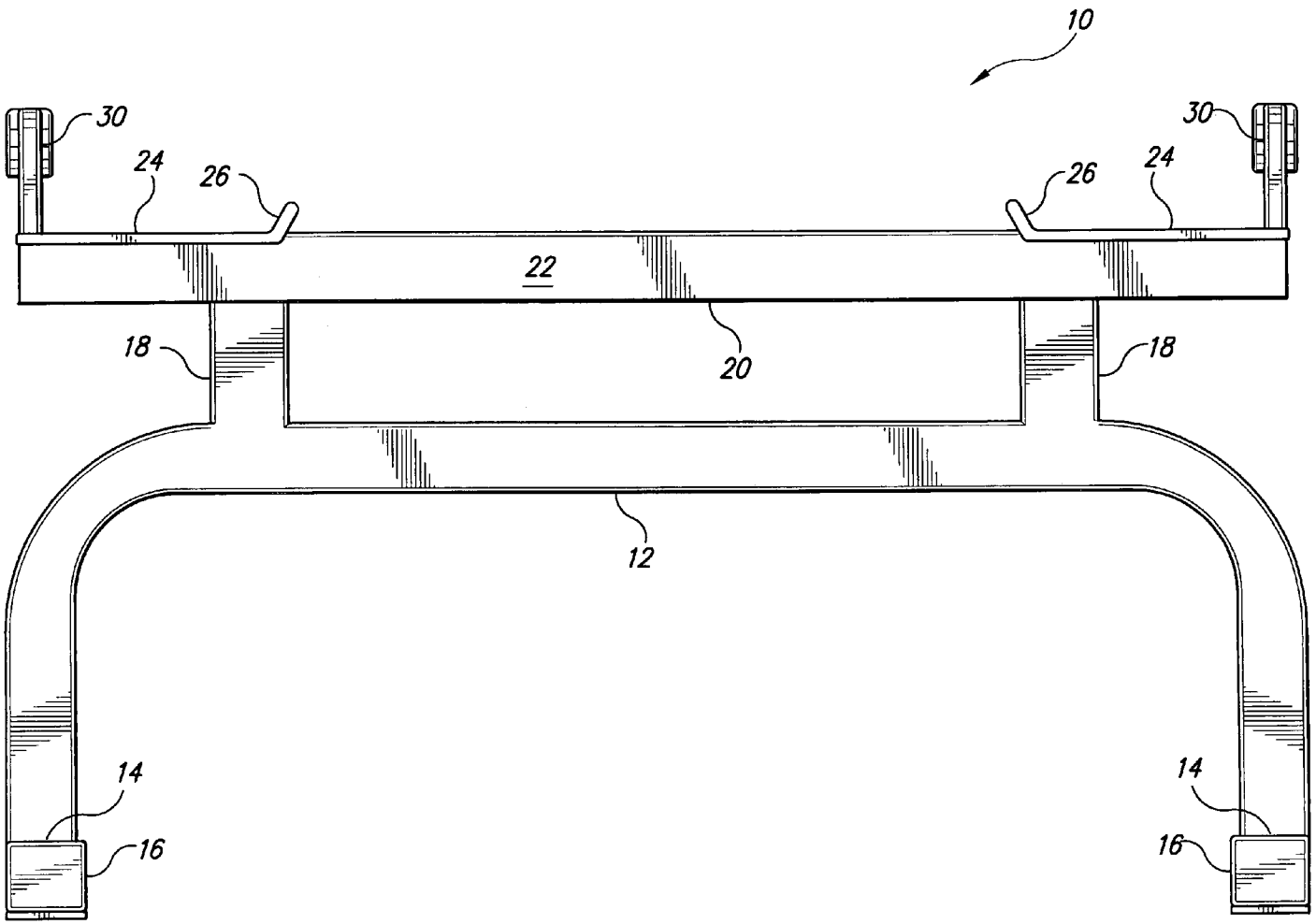
FIG. 5 is a front view of a barbell/dumbbell training support device according to the present invention.
Figure 6:
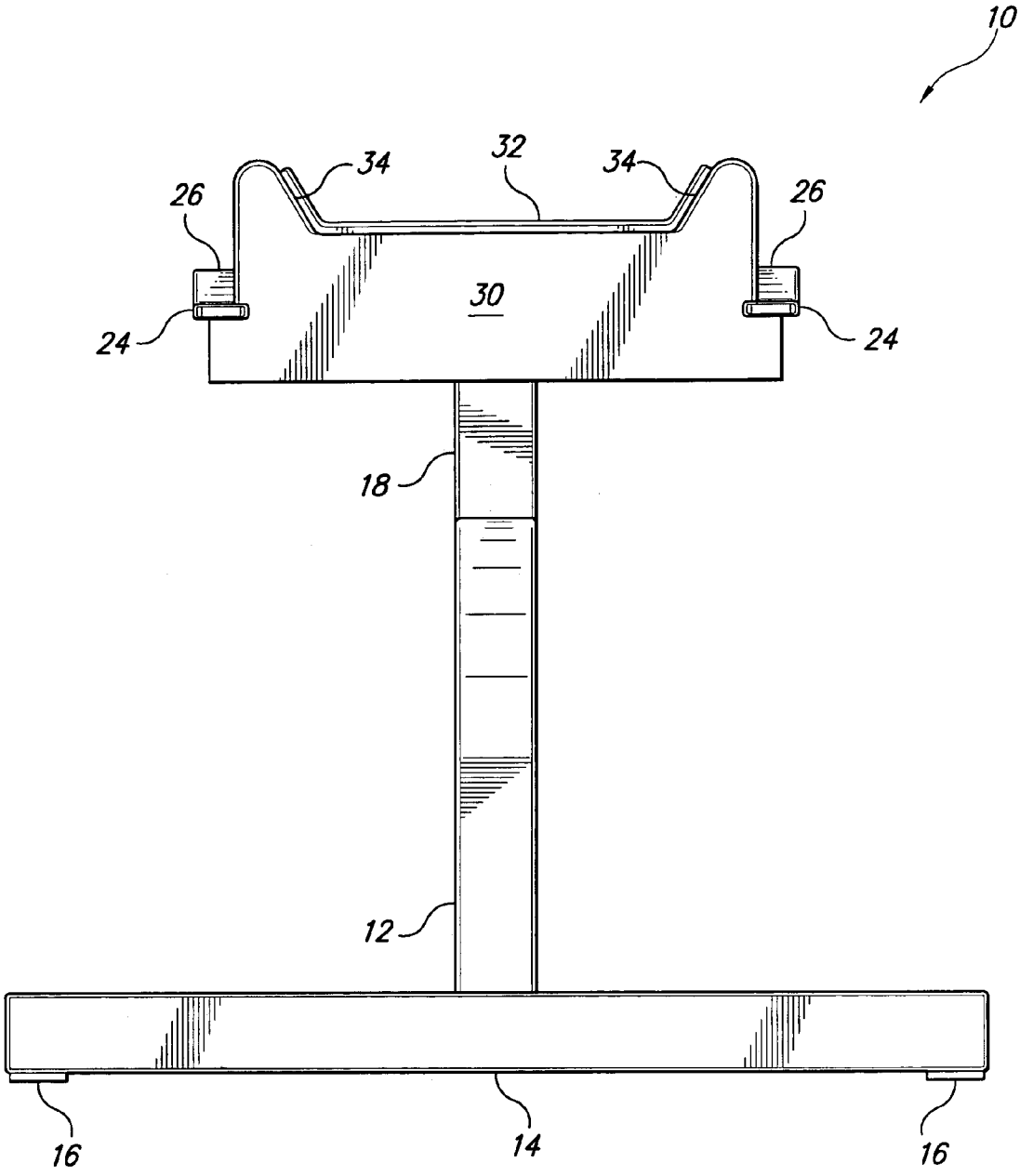
FIG. 6 is a side view of the barbell/dumbbell training support device shown in FIG. 5.
Figure 7:
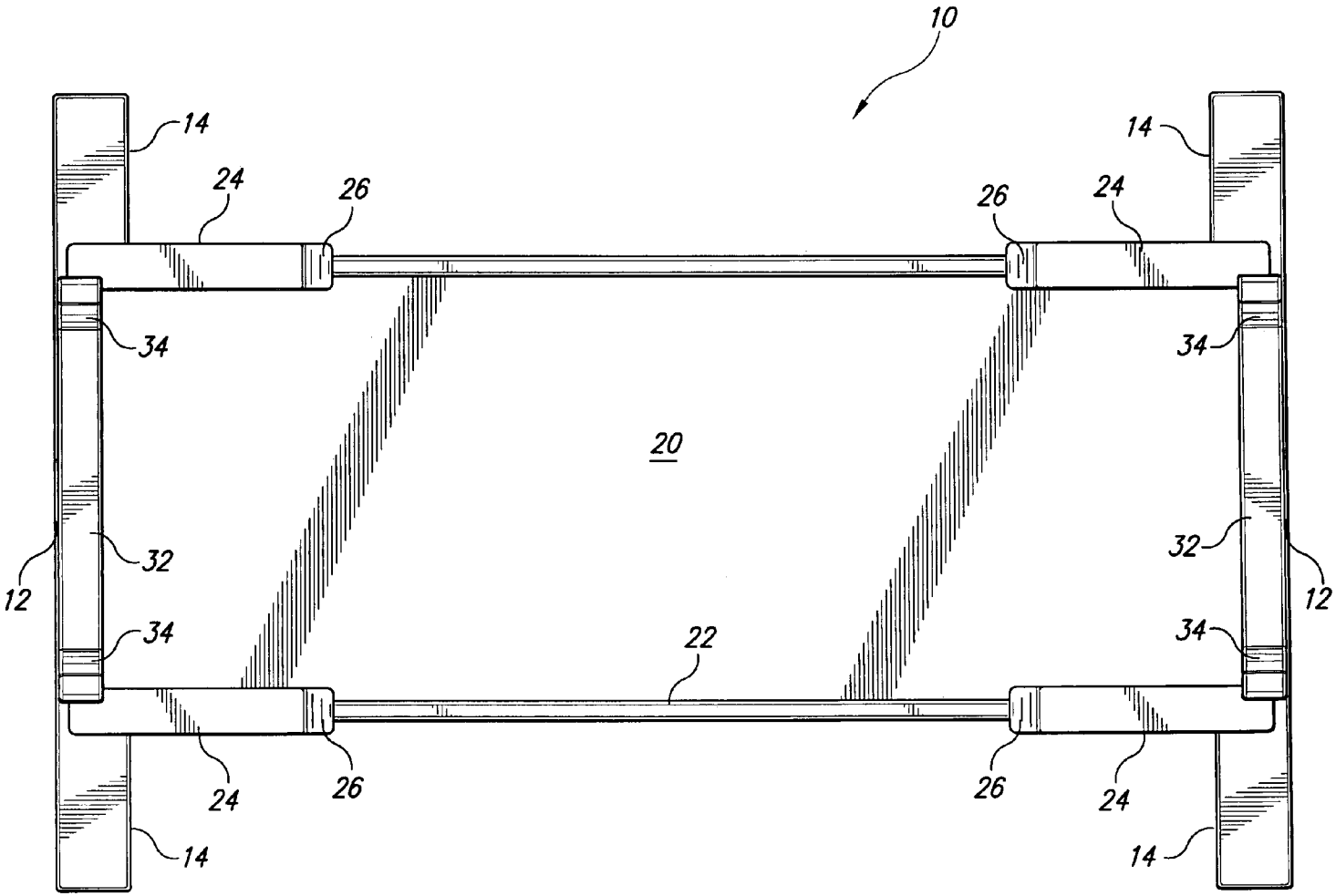
FIG. 7 is a top view of the barbell/dumbbell training support device shown in FIG. 5.

Referring to the drawings, FIGS. 1A and 1B show an individual P utilizing a barbell/dumbbell training support device 10 according to the present invention. The individual P is in the process of lifting a pair of weights W1, e.g., dumbbells W1, in FIG. 1A. The individual P has completed an exercise and has placed the dumbbells W1 on the support device 10, in FIG. 1B. The support device 10 in FIG. 2 is supporting a first pair of weights or dumbbells W1. The support device 10 in FIG. 3 is supporting a second weight or barbell W2. The barbell W2 is supported lengthwise across the support device 10. The support device 10 in FIG. 4 is supporting a third weight or barbell W3. The barbell W3 is supported crosswise across one end of the support device 10.

The barbell/dumbbell training support device 10 includes a base 12 which is interconnected with and supports an elongated tray 20 via connection elements 18. While the base 12 is illustrated as being generally U-shaped, the particular configuration of the base 12 may varied as desired, and/or may be a base retrofitted from an existing body support flat bench. The connection elements 18 longitudinally extend for a predetermined distance from the base 12, such as a few inches or the like. The connection elements 18 are preferably integrally formed with the base 12 and may also be integrally formed with the elongated tray 20. The connection elements 18 may alternatively be configured to be attached to either one or both the base 12 and the elongated tray 20 using fasteners (e.g., screws, nuts, bolts, or the like) or a fastening element (e.g., glue, paste, or the like).

Cross supports 14 may be generally rectangularly or varied as desired, and laterally extend preferably equidistantly from distal ends of the base 12 for a predetermined distance, such as one to two feet or the like. Ends of the cross supports 14 may also include pads, covers, or elevated attachments 16 having a predetermined thickness to enhance stabilization of the barbell/dumbbell training support device 10. The pads, covers, or elevated attachments 16 are preferably made from flexible and resilient material. The cross supports 14 are configured to prevent tipping of the support device 10.

The elongated tray 20 is preferably a generally elongated rectangle, though the tray 20 may be varied as desired, and is enclosed by raised edges 22 and 30 about each of the corresponding lengthwise and widthwise sides of the tray 20. Positioned along each of the lengthwise sides of the tray 20 are raised edges 22. Positioned along each of the widthwise sides of the tray 20 are raised edges 30. The elongated tray 20 may be provided with a protective coating similar to the protective lining used on truck beds.

Flat barbell support surfaces 24 may extend along the ends and on the tops of the either one or both of the raised lengthwise edges 22. Angled elements 26 may extend away from the edges of the flat barbell support surfaces 24 and above the raised edges 22 toward the center of the tray 20. Such angled elements 26 are configured to prevent barbells from sliding off of the barbell support surfaces 24.

The raised edges 30 are preferably higher than the raised edges 22. A barbell support surface 32 may extend for a predetermined distance along the center of either one or both of the widthwise raised edges 30 of the tray 20. Ends of the widthwise raised edges 30 may include longitudinally extending angled portions 34 to prevent barbells from sliding off of the barbell support surface 32. The elongated tray 20 may be configured to fit any size of dumbbell and the lengthwise and widthwise raised edges 22 and 30 may be configured to fit any size of barbell.

As described above, the base 12, connection elements 18, and elongated tray 20 of the barbell/dumbbell training support device 10 may be integrally formed of durable material, such as metal, polycarbonate, or the like, for heavy commercial use or my be provided in separate pieces requiring some assembly for better and less expensive shipping and for home use. In addition, the elongated tray 20 may be retrofitted to the base of any manufacturers body support flat bench. The barbell/dumbbell training support device may also be provided in any variety of colors.

While the invention has been described with references to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. A barbell/dumbbell training support device comprising:

a base with distal ends;

a cross support laterally extending equidistantly from each distal end of the base for a predetermined distance, the cross supports being configured to prevent tipping of the support device;

an elongated tray configured to support barbells and dumbbells;

said elongated tray being formed from a generally elongated rectangle having a surface and lengthwise sides with ends and widthwise sides with ends;

said elongated tray including raised edges extending from each of the corresponding lengthwise and widthwise sides of the tray, and flat barbell support surfaces having edges and extending along the ends and on the tops of at least one of the raised edges along the lengthwise sides of the tray; and connection elements configured to interconnect the base with the elongated tray.

2. The barbell/dumbbell training support device according to claim 1, further comprising pads, covers, or elevated attachments attached to ends of each cross support.

3. The barbell/dumbbell training support device according to claim 2, wherein said pads, covers, or elevated attachments are made from flexible and resilient material.

4. The barbell/dumbbell training support device according to claim 1, further comprising angled elements extending away from the edges of the flat barbell support surfaces and above the raised edges of the lengthwise sides and toward a center of the tray.

5. The barbell/dumbbell training support device according to claim 1, further comprising flat barbell support surfaces having edges and that extend along the center and on tops of the at least one of the raised edges along the widthwise sides of the tray.

6. The barbell/dumbbell training support device according to claim 5, further comprising longitudinally extending angled portions extending from the ends of the widthwise raised edges.

7. The barbell/dumbbell training support device according to claim 1, wherein said elongated tray further comprises a protective coating.

8. The barbell/dumbbell training support device according to claim 7, wherein said protective coating is similar to protective lining used on truck beds.

9. A barbell/dumbbell training support method comprising the steps of:

providing a base with distal ends;

providing a cross support laterally extending equidistantly from each distal end of the base for a predetermined distance, the cross supports being configured to prevent tipping of the support device;

providing an elongated tray configured to support barbells and dumbbells;

providing the elongated tray with a surface, lengthwise sides with ends, and widthwise sides with ends;

providing raised edges extending from each of the corresponding lengthwise and widthwise sides of the tray;

providing flat barbell support surfaces having edges and that extend along the ends and on tops of the at least one of the raised edges along the lengthwise sides of the tray; and interconnecting the base with the elongated tray.

10. The barbell/dumbbell training support method according to claim 9, wherein said step of providing a generally rectangular cross support further comprises providing pads, covers, or elevated attachments attached to ends of each cross support.

11. The barbell/dumbbell training support method according to claim 9, wherein said step of providing an elongated tray further comprises providing angled elements extending away from the edges of the flat barbell support surfaces and above the raised edges of the lengthwise sides and toward a center of the tray.

12. The barbell/dumbbell training support method according to claim 9, wherein said step of providing an elongated tray further comprises providing flat barbell support surfaces having edges and that extend along the center and on tops of the at least one of the raised edges along the widthwise sides of the tray.

13. The barbell/dumbbell training support method according to claim 12, wherein said step of providing an elongated tray further comprises providing longitudinally extending angled portions extending from the ends of the widthwise raised edges.

14. The barbell/dumbbell training support method according to claim 9, wherein providing an elongated tray further comprises providing the elongated tray with a protective coating.

* * * * *